United States Patent [19]

Kroisenbrunner

[11] Patent Number: 5,004,653

[45] Date of Patent: Apr. 2, 1991

[54] PRELIMINARY MATERIAL FOR THE PRODUCTION OF COMPOSITE MATERIAL PARTS AND METHOD OF MAKING

[75] Inventor: Walter Kroisenbrunner, Kapfenberg, Austria

[73] Assignee: Boehler Ges. m.b.H., Kapfenberg, Austria

[21] Appl. No.: 416,676

[22] Filed: Oct. 5, 1989

[30] Foreign Application Priority Data

Oct. 7, 1988 [AT] Austria ..... 2479/88

[51] Int. Cl.[5] ..... B32B 15/00

[52] U.S. Cl. ..... 428/615; 29/428; 29/455.1; 419/8; 419/9; 419/49

[58] Field of Search ..... 419/8, 9, 49; 428/615; 29/428, 455 R

[56] References Cited

U.S. PATENT DOCUMENTS

| | | | |
|---|---|---|---|
| 4,640,815 | 2/1987 | Brosius et al. | 419/8 |
| 4,844,863 | 7/1989 | Miyasaka et al. | 419/8 |
| 4,880,598 | 11/1989 | Kaad et al. | 419/8 |
| 4,933,141 | 6/1990 | Mankins et al. | 419/8 |

FOREIGN PATENT DOCUMENTS

| | | |
|---|---|---|
| 0114593 | 8/1984 | European Pat. Off. . |
| 227631 | 6/1943 | Switzerland . |

*Primary Examiner*—Stephen J. Lechert, Jr.

*Attorney, Agent, or Firm*—Fleit, Jacobson, Cohn, Price, Holman & Stern

[57] ABSTRACT

Preliminary material for the production of composite material parts, consisting of a tubular outer part (1) and at least one core or inner part (2) and two sealing parts (3) positioned at the ends of the tubular outer part, as well as a process for the production of the preliminary material. The sealing parts (3) project at least partially into the outer part, and a surface pressure exists at the sealing surfaces (4). The materials of the outer part and the sealing parts have at least an equal thermal expansion coefficient and a fundamentally equal deformation resistance, and the material of the sealing parts have a higher distortion temperature. The process provides for thermal shrinkage of the sealing parts prior to insertion into the tubular part, and, when necessary, followed by evacuation of a residual cavity (6) between the inner and outer parts or filling of the residual cavity with inert gas.

20 Claims, 1 Drawing Sheet

PRELIMINARY MATERIAL FOR THE PRODUCTION OF COMPOSITE MATERIAL PARTS AND METHOD OF MAKING

BACKGROUND OF THE INVENTION

The invention relates to a preliminary material for the production of composite material parts by means of hot-forming or hot isostatic pressing, which preliminary material consists of a tubular outer part which, when so desired, will form a component of the composite part after forming and of at least one core or inner part, consisting of solid and/or powdered material and comprising the other component(s) in the finished product, and of two sealing parts positioned on the front of the tubular outer part, which sealing parts may display a gas feed; and to a process for the production of the preliminary material.

Composite materials are employed to advantage in machine parts and tools which are simultaneously subjected to various demands, e.g. chemical resistance and hardness, or strength, or toughness and resistance to wear. Composite materials can be created by means of fusion-welded plating and the like, or by means of a metallic connection created by hot-forming between two or more parts.

In the creation of a metallic connection by means of hot forming, individual parts are generally enclosed in a casing (compare Swiss Patent No. 227 631), which is welded so as to be gastight (compare U.S. Pat. No. 4,640,815), and a residual cavity in the casing is filled with inert gas by means of a gas feed so as to provide an adequate metal bond or to prevent oxidation of the surface of the parts during heating to the deformation temperature, or is evacuated, whereupon the cavity is sealed (compare European Patent Document No. EP-A-0114593).

Composite materials with an inner component and with an outer component enclosing this inner component, particularly in concentric fashion, are advantageously and cost-effectively produced from preliminary material; here the outer part simultaneously serves as the casing jacket, and merely the casing base or, as the case may be, the sealing parts need be welded to the front of the outer part. A disadvantage arises when the outer part consists of a poorly weldable material or of one that can only be welded after preliminary heating, as is the case e.g. in cold-work steel (e.g. material DIN 1.2378 and the like) and when additional measures become necessary - for example, the application of so-called buffer welding with intermediate annealings of the entire outer part and with cleaning or descaling, particularly of the zone affected by the heat - before the sealing parts can be welded in gastight fashion and before the welding seam remains crack-free even during heating of the preliminary material to the treatment temperature and also free of cracks in the base material. Additional measures of this type are very expensive and do not usually possess adequate production safety. For this reason and because under certain circumstances several special materials cannot be joined by fusion welding to the sealing parts while meeting the given requirements, it is frequently necessary to produce the preliminary material by welding the parts to be joined in a lost casing of weldable material.

BRIEF SUMMARY OF THE INVENTION

It is an object of the invention to avoid the above-indicated disadvantages and to provide a preliminary material for the production of composite material parts and a process for the production of the prelminary material.

In the invention the sealing parts at least partially project into a tubular outer part, preferably in the area of the seal, the wall section of which outer part displays grades steps such that a surface pressure works upon the fitting surfaces, which surfaces are produced with a roughness or roughness depth RA of at least 200 μm, preferably a maximum of 10 μm, particularly 4 μm; and as needed the sealing parts on the outside display mounting fixtures, for example pins, pocket holes, or the like, and on the inside display, as needed, one or several centering or positioning points for the inner part(s); and as compared with the material of the outer part, the sealing parts consist of a material with at least an equal, but particularly a higher, coefficient of expansion and preferably with a higher hot-forming capacity, given a fundamentally equal deformation resistance, at the treatment temperature of the preliminary material, and with a distortion temperature exceeding this temperature by at least 90° C.; and when necessary the residual cavity in the preliminary material is filled with inert gas or is evacuated. It is particularly advantageous if the sealing parts consist of an austenitic alloy, particularly a chromium nickel steel or a manganese steel or a nickel-manganese steel.

BRIEF DESCRIPTION OF THE DRAWING

The invention will now be described in greater detail with reference to the accompanying drawings wherein.

DETAILED DESCRIPTION

In the process for the production of the preliminary material a sealing part 3 is positioned in a tubular outer part 1 which, if necessary, has been previously heated, the sealing part displaying a temperature at least 50° C., preferably 100° C., particularly 150° C. lower than the outer part; the sealing part 3 is held in position until temperature equilibrium is reached, after which one or several inner part(s) 2,8, if so required compressed in powder form according to processes known to the prior art, are inserted into the outer part sealed at one end, and a second sealing part is fixed within the outer part according to the same process of fixing the first sealing part; when necessary, inert gas is introduced into the residual cavity 6 of the preliminary material by means of a gas feed 5, or the residual cavity is evacuated, after which the gas feed is sealed. It is advantageous if the outer part is left at room temperature and the temperature difference is effected by cooling the sealing parts in a coolant, e.g. liquid air or liquid nitrogen.

Contrary to the prejudice of experts - that cracks will form with a shrinkage fit or with high tensile stresses arising in the outer part due to expansion of the sealing parts, particularly when the outer part is constructed of brittle material, and that further cracks will form due to increasing tensile stresses and a decrease of ductility in the material when the brittle temperature is passed during heating to the deformation temperature - it was discovered that cracks do not form in the outer part even during heating, particularly with sealing parts of austenitic material, and even if the outer part is constructed of less tough or brittle material. Surprisingly, it was also discovered that the gas-tightness or vacuum-tightness of the shrinkage fit is maintained even when structural transformations, associated with changes in volume, occur in the material of the outer part due to heating.

Figure 1:
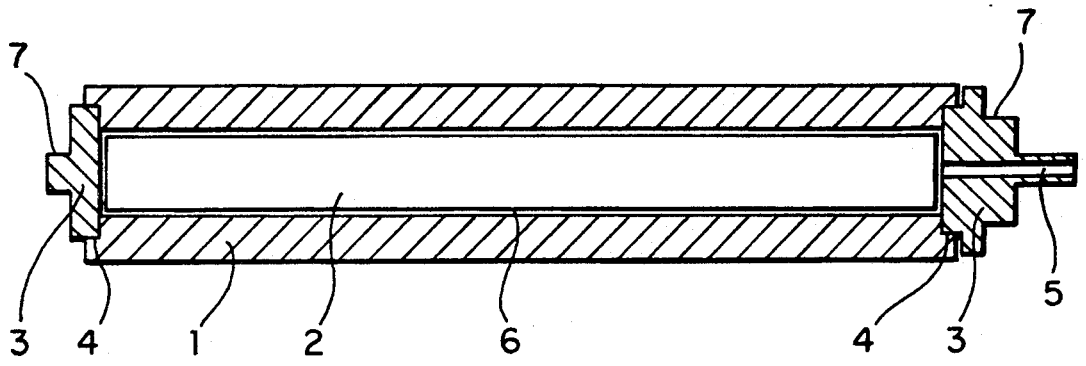
FIG. 1 is a cross-sectional view which shows a preliminary material for a composite material part consisting of two components.

As can be seen from FIG. 1, a solid inner part 2 is applied to an outer part 1, into which the sealing parts 3 partially project on the front side. The fitting surfaces 4 are formed by means of the stepped or graded cross-section of the outer part wall and accomodate the corresponding portions of the sealing parts. The sealing parts 3 have mounting fixtures 7, and one sealing part has a gas feed 5. A residual cavity 6 is formed in the preliminary material between the outer part 1 and the inner part 2.

Figure 2:
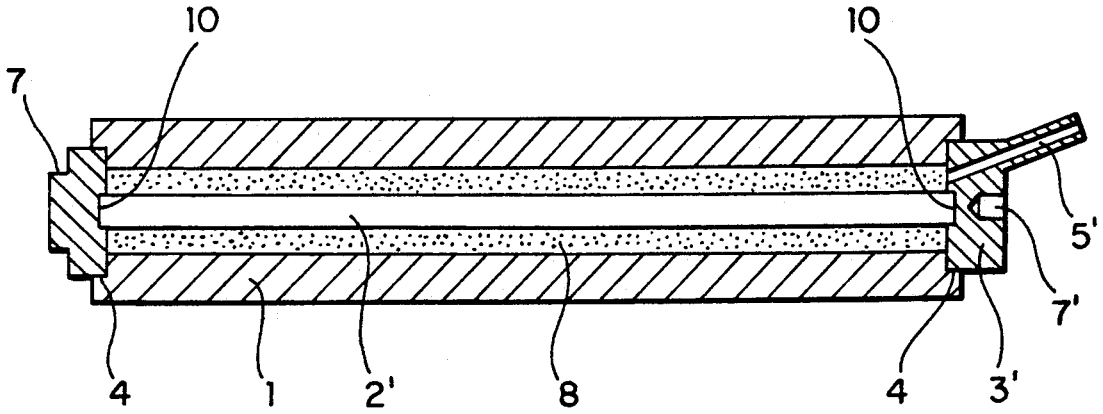
FIG. 2 is a view similar to FIG. 1 showing a preliminary material for the production of a composite material part consisting of three components.

FIG. 2 shows a preliminary material for the production of a composite material part consisting of three components, in which a powdery intermediate part 8 is positioned between a solid core part 2', which is held in place by the positioning points 10 of the sealing parts 3', and an outer part 1 into which the sealing parts project. The sealing part 3', which has a gas, feed 5', displays a mounting fixture in the form of a pocket hole 7'.

I claim:

1. Preliminary material for the production of composite material parts by hot-forming treatment or hot isostatic pressing treatment, comprising:

a tubular outer part;

stepped ends on said tubular outer part forming sealing surfaces at said ends and having a smaller dimension than the outer diameter of said outer part;

at least one inner part within said outer part;

a residual cavity between said outer part and said at least one inner part;

sealing parts at said ends of said outer part projecting at least partially into said ends of said outer part and having sealing surfaces thereon engaging said sealing surfaces on said outer part, said sealing parts comprising a material having a thermal coefficient of expansion at least equal to that of said outer part and deformation resistance substantially equal to that of said outer part at the treatment temperature for forming the composite material, and said material of said sealing parts having a distortion temperature exceeding said treatment temperature by at least 90° C.; and a roughness on at least one of said sealing surfaces of said outer member and said sealing surfaces of said sealing parts;

so that a surface pressure exists at said sealing surfaces when said sealing parts and outer part are at substantially the same temperature.

2. Material as claimed in claim 1 wherein:

said at least one inner part is solid.

3. Material as claimed in claim 1 where:

said at least one inner part comprises a first solid inner core and a second powder material in said residual cavity between said core and said outer part.

4. Material as claimed in claim 1 and further comprising:

a fluid passage means in at least one of said sealing parts communicating with said residual cavity.

5. Material as claimed in claim 3 and further comprising:

a fluid passage means in at least one of said sealing parts communicating with said residual cavity.

6. Material as claimed in claim 1 wherein:

said roughness comprises a roughness depth in the range between 4 μm and 200 μm.

7. Material as claimed in claim 2 wherein:

said roughness comprises a roughness depth in the range between 4 μm and 200 μm.

8. Material as claimed in claim 3 wherein:

said roughness comprises a roughness depth in the range between 4 μm and 200 μm.

9. Material as claimed in claim 1 wherein:

said sealing parts have a higher thermal expansion coefficient than said outer part.

10. Material as claimed in claim 3 wherein:

said sealing parts have a higher thermal expansion coefficient than said outer part.

11. Material as claimed in claim 1 wherein:

said sealing parts have a higher hot-forming capacity than said outer part.

12. Material as claimed in claim 10 wherein:

said sealing parts have a higher hot-forming capacity than said outer part.

13. Material as claimed in claim 1 and further comprising:

an inert gas in said residual cavity.

14. Material as claimed in claim 5 and further comprising:

an inert gas in said residual cavity.

15. Material as claimed in claim 1 wherein:

said sealing parts comprise a material selected from the group consisting of austenitic steel, chrome-nickel steel, manganese steel, and nickel-manganese steel.

16. Method for producing preliminary material used in the production of composite material parts by hot-forming, comprising:

providing a tubular outer part having two ends;

providing at least one inner part for insertion within said outer part;

providing two sealing parts for partly inserting into the ends of said outer part;

cooling one of said sealing parts to a temperature at least 50° C. lower than the temperature of one of said ends of said outer part;

inserting said cooled one sealing part into one of said ends of said outer part;

maintaining said one sealing part in said one end of said outer part until temperature equilibrium is achieved and said one sealing part seals said one end of said outer part;

inserting said at least one inner part into said outer part;

cooling the other of said sealing parts to a temperature at least 50° C.; lower than the temperature of the other end of said outer member;

inserting said other sealing part into said other end of said outer part; and, maintaining said other sealing part in said other end of said outer part until temperature equilibrium is achieved and said other sealing part is sealed in said other end of said outer tube.

17. The method as claimed in claim 16 wherein:

said outer part is maintained at room temperature; and said sealing parts are cooled by a coolant selected from the group consisting of liquid air and liquid nitrogen.

18. The method as claimed in claim 16 and further comprising:

providing a residual cavity between said at least one inner part and said outer part; and introducing inert gas into said residual cavity.

19. Preliminary material as claimed in claim 1 produced by the process comprising:

providing a tubular outer part having two ends;

providing at least one inner part for insertion within said outer part;

providing two sealing parts for partly inserting into the ends of said outer part;

cooling one of said sealing parts to a temperature at least 50° C. lower than the temperature of one of said ends of said outer part;

inserting said cooled one sealing part into one of said ends of said outer part;

maintaining said one sealing part in said one end of said outer part until temperature equilibrium is achieved and said one sealing parts seals said one of said outer part;

inserting said at least one inner part into said outer part;

cooling the other of said sealing parts to a temperature at least 50° C. lower than the temperature of the other end of said outer member;

inserting said other sealing part into said other end of said outer part; and maintaining said other sealing part in said other end of said outer part until temperature equilibrium is achieved and said other sealing part is sealed in said other end of said outer tube.

20. The method as claimed in claim 16 wherein:

said cooling steps comprise cooling said sealing parts to a temperature 150° C. lower than the ends of said outer part.

* * * * *